US005516108A

United States Patent [19]

Foster et al.

[11] Patent Number: 5,516,108

[45] Date of Patent: May 14, 1996

[54] YARD GOLF GAME

[76] Inventors: Kenneth D. Foster, Box 118, Prescott, Iowa 50859; Lynn D. Winterhof, 5679 "Y" Ave., Aurelia, Iowa 51005

[21] Appl. No.: 359,395

[22] Filed: Dec. 20, 1994

[51] Int. Cl.[6] ..... A63B 67/02

[52] U.S. Cl. ..... 473/176; 473/179; 473/195; 473/158; 473/170

[58] Field of Search ..... 273/34 R, 176 R, 273/176 A, 176 AA, 176 AB, 176 B, 176 D, 176 E, 176 F, 176 H, 177 R, 178 R, 178 A, 178 B, 177 A, 181 R, 193 R

[56] References Cited

U.S. PATENT DOCUMENTS

| | | | |
|---|---|---|---|
| 1,503,283 | 7/1924 | Page | 273/176 AA |
| 2,157,023 | 5/1939 | Shannon | 273/176 B |
| 2,626,152 | 1/1953 | Miller | 273/176 B |
| 2,974,958 | 3/1961 | O'Herron | 273/176 B |
| 3,027,163 | 3/1962 | Saatzer | 273/176 B |
| 3,652,095 | 3/1972 | Furnari et al. | 273/176 AA |
| 4,057,030 | 11/1977 | Womack | 273/34 R |
| 5,090,704 | 2/1992 | Dona | 273/177 R |
| 5,310,189 | 5/1994 | Soto | 273/193 R |
| 5,316,292 | 5/1994 | Browne | 273/34 R |

FOREIGN PATENT DOCUMENTS

| | | | |
|---|---|---|---|
| 208292 | 12/1923 | United Kingdom | 273/176 B |

*Primary Examiner*—Steven B. Wong

[57] ABSTRACT

A new and improved yard golf game comprised of a plurality of golf clubs. Included in the game are a plurality of hazards each having two spikes extending from a bottom portion thereof. The two spikes serve to embed the hazards into the yard. Included in the game are a plurality of golf holes each having a bottom portion and a cylindrical side wall extending perpendicularly upward therefrom. The cylindrical side wall terminates in an open upper periphery. The bottom portion has an aperture formed therethrough. Included in the game are a plurality of lids. Each lid is adapted to be received within open upper periphery of the plurality of golf holes. Included in the game are a plurality of golf balls. The golf balls are adapted to be received within the plurality of golf holes.

1 Claim, 4 Drawing Sheets

YARD GOLF GAME

BACKGROUND OF THE INVENTION

1. Field of the Invention

The present invention relates to a yard golf game and more particularly pertains to simulating a game of golf which can be played right in one's yard with a yard golf game.

2. Description of the Prior Art

The use of golf courses is known in the prior art. More specifically, golf courses heretofore devised and utilized for the purpose of practicing golf are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,265,875 to Fitzgerald discloses a reduced area, night playable golf course.

U.S. Pat. No. 5,116,059 to Pelletier discloses a golf practice apparatus.

U.S. Pat. No. 5,092,600 to Ruth, Jr. et al. discloses an indoor-outdoor golf course.

U.S. Pat. No. 5,011,155 to Udomkesmalee et al. discloses a golf practice device.

U.S. Pat. No. 4,878,671 to Gubnay discloses a yard golf game apparatus.

While these devices fulfill their respective, particular objective and requirements, the aforementioned patents do not describe a yard golf game for simulating a game of golf which can be played right in one's yard.

In this respect, the yard golf game according to the present invention substantially departs from the conventional concepts and designs of the prior art, and in doing so provides an apparatus primarily developed for the purpose of simulating a game of golf which can be played right in one's yard.

Therefore, it can be appreciated that there exists a continuing need for new and improved yard golf game which can be used for simulating a game of golf which can be played right in one's yard. In this regard, the present invention substantially fulfills this need.

SUMMARY OF THE INVENTION

In the view of the foregoing disadvantages inherent in the known types of golf courses now present in the prior art, the present invention provides an improved yard golf game. As such, the general purpose of the present invention, which will be described subsequently in greater detail, is to provide a new and improved yard golf game and method which has all the advantages of the prior art and none of the disadvantages.

To attain this, the present invention essentially comprises a plurality of adult golf clubs. Each of the golf clubs has a handle portion, a shaft portion, and a head portion. The game includes a plurality of child golf clubs. Each of the golf clubs has a handle portion, a shaft portion, and a head portion. The game includes a plurality of rounded hazards. Each of the rounded hazards has two spikes extending from a bottom portion thereof. The two spikes serve to embed the rounded hazards into the yard. The game includes a plurality of rectangular hazards. Each of the rectangular hazards has two spikes extending from a bottom portion thereof. The two spikes serve to embed the rectangular hazards into the yard. The game includes a plurality of arched hazards. Each of the arched hazards has two spikes extending from a bottom portion thereof. The two spikes serve to embed the arched hazards into the yard. The game includes a plurality of golf holes. Each of the golf holes has a bottom portion and a cylindrical side wall extending perpendicularly upward therefrom. The cylindrical side wall terminates in an open upper periphery. The bottom portion has an aperture formed therethrough. The game includes a plurality of lids. Each of the lids is adapted to be received within the open upper periphery of the plurality of golf holes. The game includes a plurality of flags. Each of the flags has a first surface and a second surface. Each of the flags has a shaft extending downwardly therefrom. Each of the shafts has an end portion adapted to be received within the aperture formed through the plurality of golf holes. The game includes a plurality of stick-on numbers. Each of the stick-on numbers is adapted to be coupled with the first surface and the second surface of the plurality of flags. The stick-on numbers serve to indicate a number of a golf hole. The game includes a plurality of golf balls. Each of the golf balls is adapted to be received within the plurality of golf holes.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved yard golf game which has all the advantages of the prior art golf courses and none of the disadvantages.

It is another object of the present invention to provide a new and improved yard golf game which may be easily and efficiently manufactured and marketed.

It is a further object of the present invention to provide a new and improved yard golf game which is of durable and reliable construction.

An even further object of the present invention is to provide a new and improved yard golf game which is susceptible of a low cost of manufacture with regard to both materials and labor, and which accordingly is then susceptible of low prices of sale to the consuming public, thereby making such a yard golf game economically available to the buying public.

Still yet another object of the present invention is to provide a new and improved yard golf game which provides in the apparatuses and methods of the prior art some of the advantages thereof, while simultaneously overcoming some of the disadvantages normally associated therewith.

Even still another object of the present invention is to provide a new and improved yard golf game for simulating a game of golf which can be played right in one's yard.

Lastly, it is an object of the present invention to provide a new and improved yard golf game comprised of a plurality of golf clubs. Included in the game are a plurality of hazards each having two spikes extending from a bottom portion thereof. The two spikes serve to embed the hazards into the yard. Included in the game are a plurality of golf holes each having a bottom portion and a cylindrical side wall extending perpendicularly upward therefrom. The cylindrical side wall terminates in an open upper periphery. The bottom portion has an aperture formed therethrough. Included in the game are a plurality of lids each of is adapted to be received within the open upper periphery of the plurality of golf holes. Included in the game are a plurality of golf balls. The golf balls are adapted to be received within the plurality of golf holes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
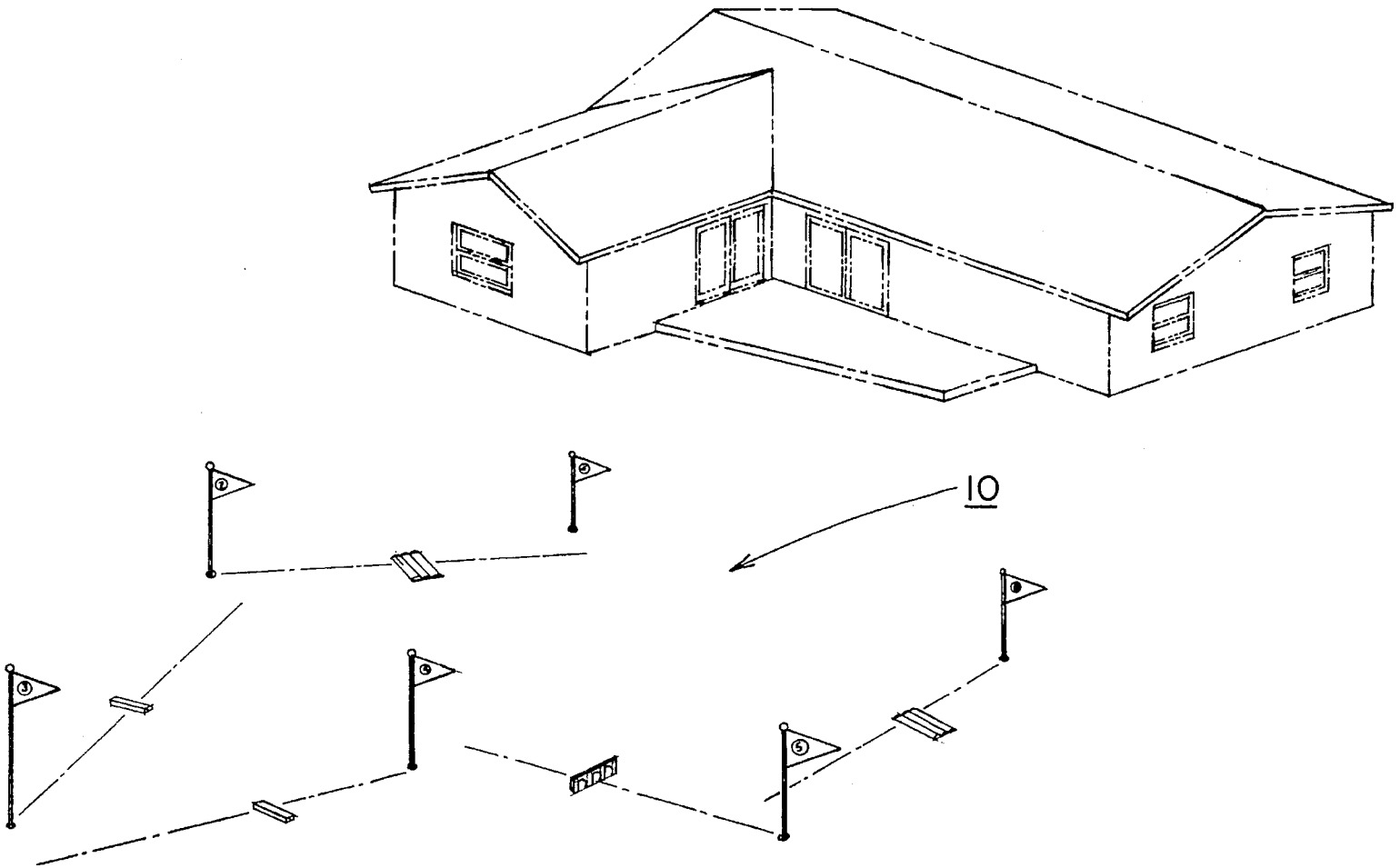
FIG. 1 is a perspective view of the preferred embodiment of the yard golf game constructed in accordance with the principles of the present invention.
Figure 2:
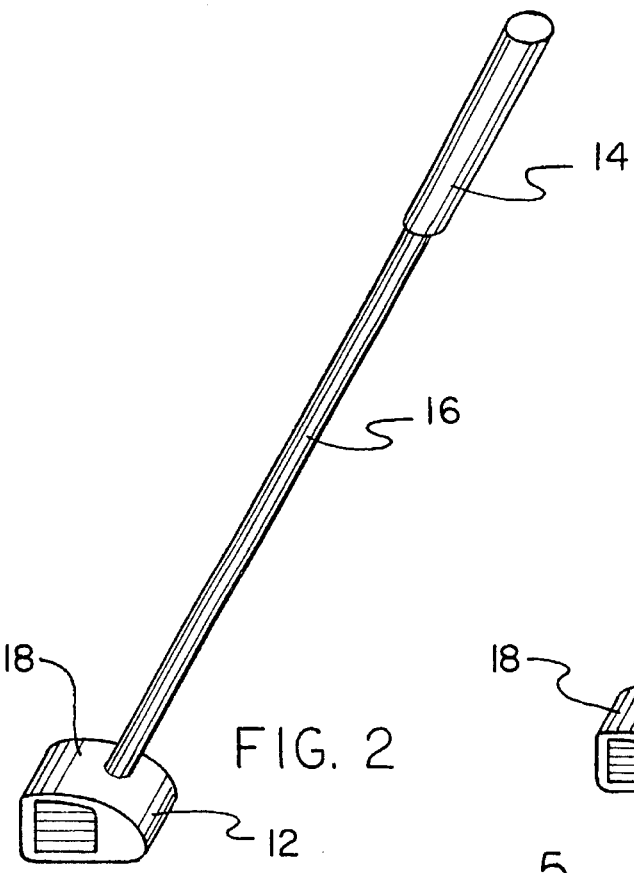
FIG. 2 is a perspective view of the adult golf club of the present invention.
Figure 3:
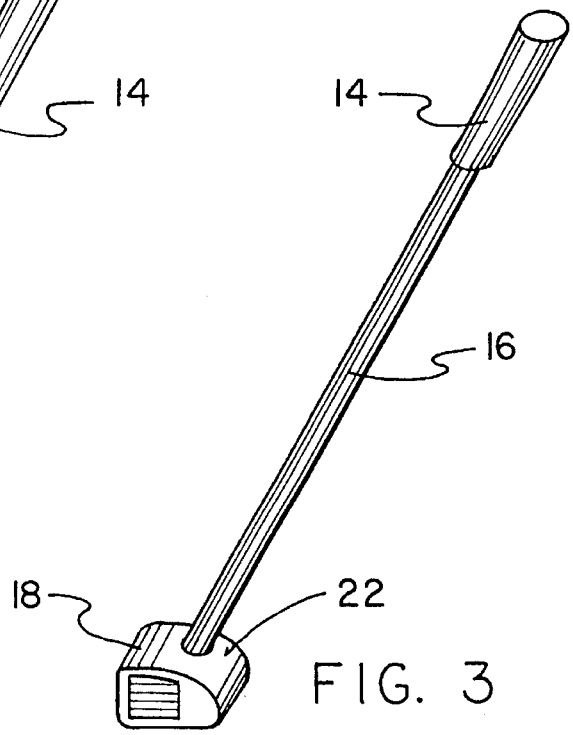
FIG. 3 is a perspective view of the child golf club of the present invention.
Figure 4:
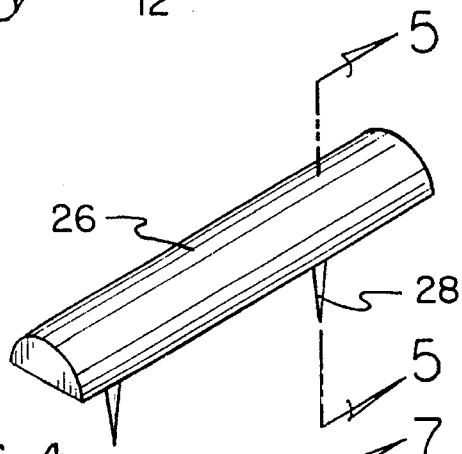
FIG. 4 is a perspective view of the rounded hazard of the present invention.
Figure 5:
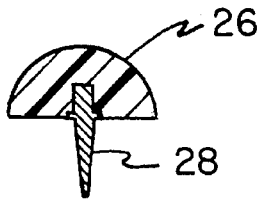
FIG. 5 is a cross-sectional view as taken along line 5—5 of FIG. 4.
Figure 6:
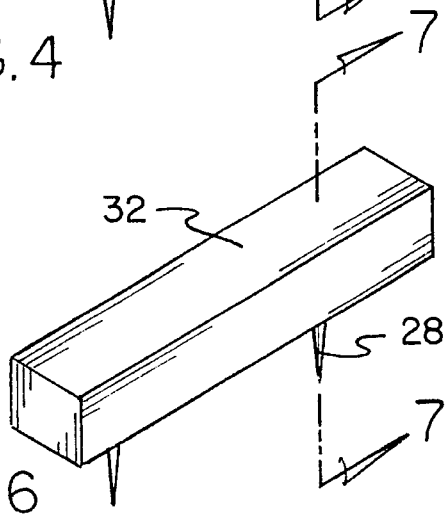
FIG. 6 is a perspective view of the rectangular hazard of the present invention.
Figure 7:
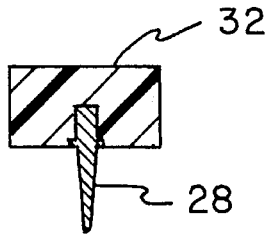
FIG. 7 is a cross-sectional view as taken along line 7—7 of FIG. 6.
Figure 8:
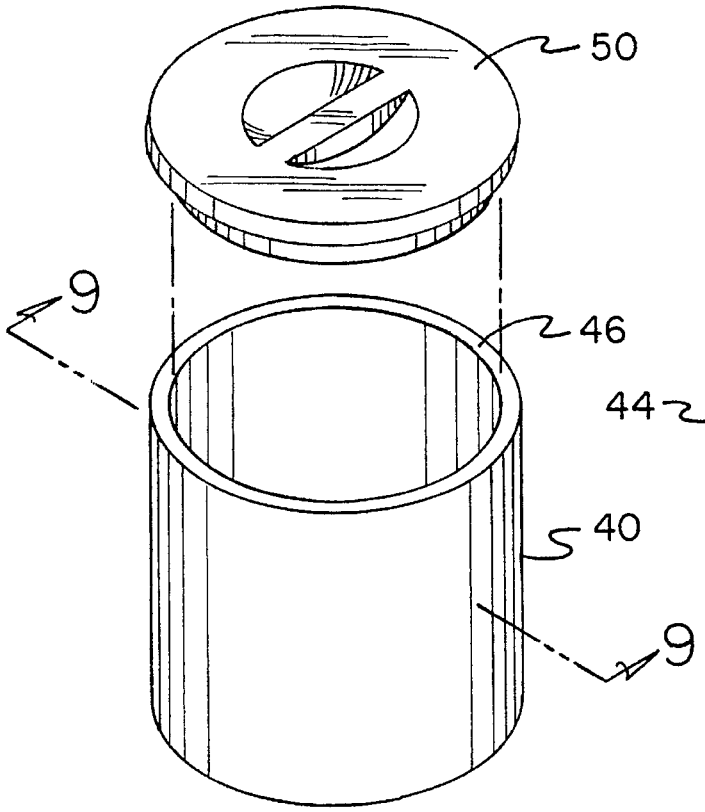
FIG. 8 is a perspective view of the hole with cover of the present invention.
Figure 9:
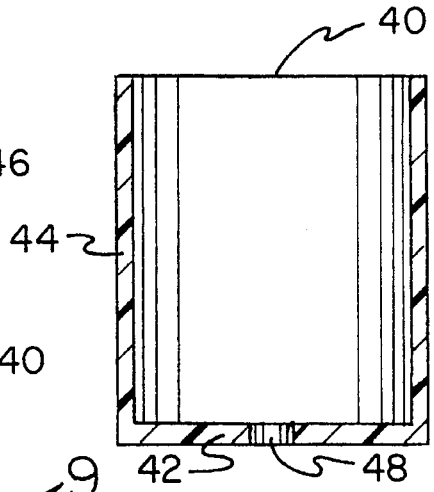
FIG. 9 is a cross-sectional view as taken along line 9—9 of FIG. 8.
Figure 10:
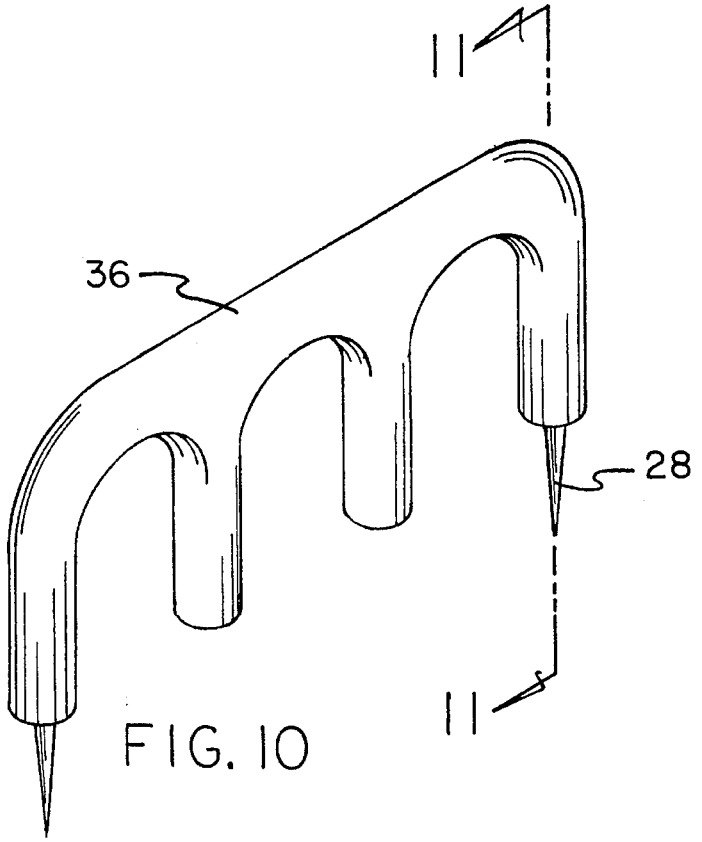
FIG. 10 is a perspective view of the arches of the present invention.
Figure 11:
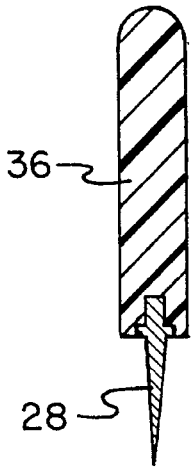
FIG. 11 is a cross-sectional view as taken along line 11—11 of FIG. 10.
Figure 12:
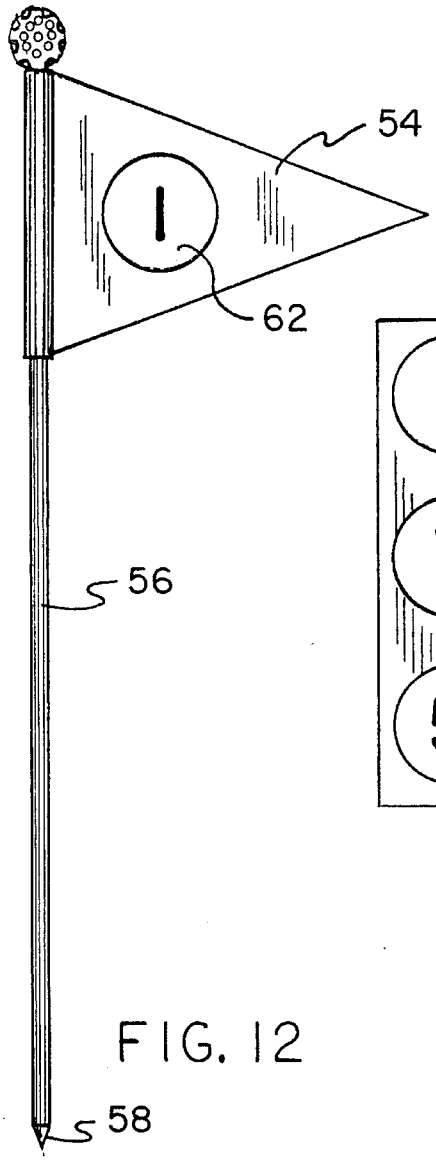
FIG. 12 is a front elevation view of the flag of the present invention.
Figure 13:
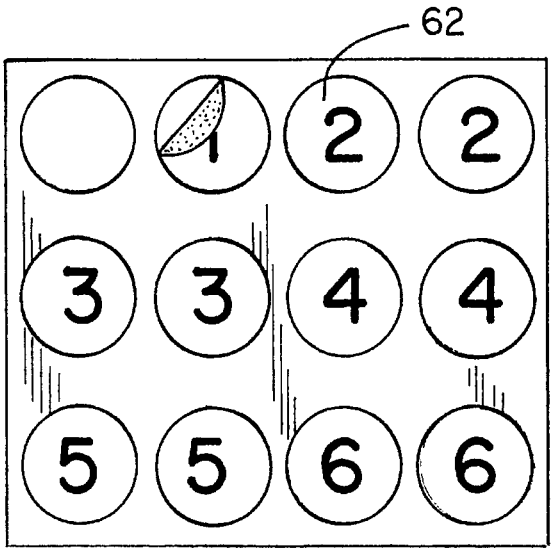
FIG. 13 is a front elevation view of the stick-on numbers of the present invention.
Figure 14:
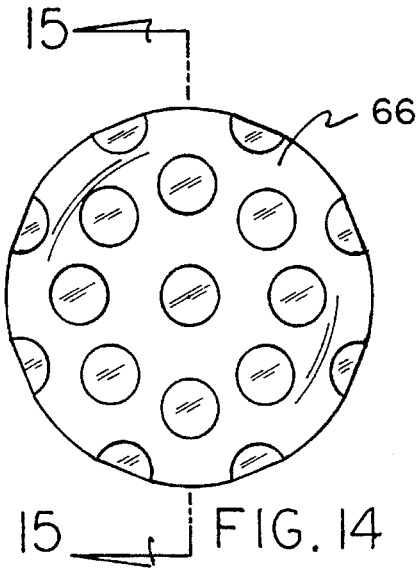
FIG. 14 is a front view of the ball of the present invention.
Figure 15:
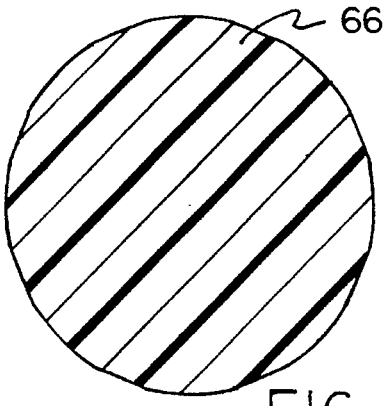
FIG. 15 is a cross-sectional view as taken along line 15—15 of FIG. 14.

With reference now to the drawings, and in particular, to FIG. 1 thereof, the preferred embodiment of the new and improved yard golf game embodying the principles and concepts of the present invention and generally designated by the reference number 10 will be described.

Specifically, it will be noted in the various Figures that the device relates to a new and improved yard golf game for simulating a game of golf which can be played right in one's yard. In its broadest context, the device consists of a plurality of adult golf clubs, a plurality of child golf clubs, a plurality of rounded hazards, a plurality of rectangular hazards, a plurality of arched hazards, a plurality of golf holes, a plurality of lids, a plurality of flags, a plurality of stick-on numbers, and a plurality of golf balls.

The game 10 includes a plurality of adult golf clubs 12. Each of the golf clubs 12 has a handle portion 14, a shaft portion 16, and a head portion 18. The shaft portion 16 is fabricated of a hard plastic. The three portions of the adult golf club 12 are molded together as one piece.

The game 10 includes a plurality of child golf clubs 22. Each of the child golf clubs 22 has a handle portion 14, a shaft portion 16, and a head portion 18. The shaft portion 16 is fabricated of a hard plastic. The three portions of the child golf club 22 are molded together as one piece. The child golf clubs 22 are shorter in length to accommodate a child.

The game 10 includes a plurality of rounded hazards 26. Each of the rounded hazards 26 has two spikes 28 extending from a bottom portion thereof. The two spikes 28 serve to embed the rounded hazards 26 into the yard. The rounded hazards 26 serve as obstacles for the user to overcome in order to accomplish his or her objective. The amount of rounded hazards 26 used for each golf hole can vary to accommodate different skill levels of the individual users. The sizes of the rounded hazards 26 can vary from 12" up to 18" in length.

The game 10 includes a plurality of rectangular hazards 32. Each of the rectangular hazards 32 has two spikes 28 extending from a bottom portion thereof. The two spikes 28 serve to embed the rectangular hazards 32 into the yard. The rectangular hazards 32 serve as obstacles for the user to overcome in order to accomplish his or her objective. The amount of rectangular hazards 32 used for each golf hole can vary to accommodate different skill levels of the individual users. The rectangular hazards 32 are fabricated of a hard plastic.

The game 10 includes a plurality of arched hazards 36. Each of the arched hazards 36 has two spikes 28 extending from a bottom portion thereof. The two spikes 28 serve to embed the arched hazards 36 into the yard. The arched hazards 36 serve as obstacles for the user to overcome in order to accomplish his or her objective. The amount of arched hazards 36 used for each golf hole can vary to accommodate different skill levels of the individual users. The arched hazards 36 will come in a variety of colors that allow them to stand out when in place in the yard.

The game 10 includes a plurality of golf holes 40. Each of the golf holes 40 has a bottom portion 42 and a cylindrical side wall 44 extending perpendicularly upward therefrom. The cylindrical side wall 44 terminates in an open upper periphery 46. The bottom portion 42 has an aperture 48 formed therethrough. The golf holes 40 are positioned within the yard with only the open upper periphery 46 visible. The preferred amount of holes 40 is six, but additional holes 40 could be made available separately. The golf holes 40 are fabricated of PVC pipe which is five inches in diameter and about five inches deep.

The game 10 includes a plurality of lids 50. Each of the lids 50 is adapted to be received within the open upper periphery 46 of the plurality of golf holes 40. The lids each include a flange extending downwardly therefrom inwardly of an outer periphery thereof, with the flange snapidly engaging the open upper periphery of the golf hole, each lid also having an indented handle formed therein for the engagement and disengagement of the lid from the hole. The lids 50 allow the golf holes 40 to be covered when not in use, thus preventing injury from people walking across the yard.

The game 10 includes a plurality of flags 54. Each of the flags 54 has a first surface and a second surface. Each of the flags 54 has a shaft 56 extending downwardly therefrom. Each of the shafts 56 has an end portion 58 adapted to be received within the aperture 48 formed through the plurality of golf holes 40. The flags 54 extend outwardly of the golf holes 40 to indicate the location of each golf hole 40.

The game 10 includes a plurality of stick-on numbers 62. Each of the stick-on numbers 62 is adapted to be coupled with the first surface and the second surface of the plurality of flags 54. The stick-on numbers 62 serve to indicate a number of a golf hole 40.

The game 10 includes a plurality of golf balls 66. Each of the golf balls 66 is adapted to be received within the plurality of golf holes 40. The golf ball 66 is preferably about 2½ inches in diameter and having a relatively high density thus allowing the golf balls 66 to roll unobstructively within the grass of the yard. The preferred number of golf balls 66 is six, with each individual golf ball 66 having its own color thereby differentiating the many users involved.

The present invention is a game that is designed to simulate the game of golf, which can be played by as many as four people right in one's yard.

All of the equipment required for six holes is offered in this basic package, and additional holes and hazards could be offered separately to create courses with more holes. Four clubs are provided for adults and four for children; the former thirty-six inches long while the child's version is twenty-eight inches long, and each has a large plastic head. The holes are made of plastic pipe and are five inches in diameter and five inches deep; a cover is provided for each hole. The holes are made of plastic and incorporate stakes which can be embedded, and these include a set of arches, a humped area and rippled sections which can be clipped together or laid out separately. Six balls are included.

One can lay out a course to suit a personal preference, and it can be made easy or more difficult depending on the players involved. The game is then played like the game of golf with the object being to attain the lowest score. The game can be played competitively using the provided scorecards, and the clubs and larger balls will serve to offset the advantage to adults.

The course can be set up quickly, and the game can be played by the entire family. When the course is not in use, it is simple matter to cover each of the holes with the covers so the yard will be safe to walk in.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved yard golf game for simulating a game of golf which can be played right in one's yard comprising, in combination:

a plurality of adult golf clubs, each of the golf clubs having a handle portion, a shaft portion, and a head portion;

a plurality of child golf clubs, each of the golf clubs having a handle portion, a shaft portion, and a head portion, each of the child golf clubs being shorter in length than the adult golf clubs;

a plurality of semi-cylindrical hazards, each of the semi-cylindrical hazards having two spikes extending from a bottom portion thereof, the two spikes serving to embed the semi-cylindrical hazards into the yard;

a plurality of rectangular hazards, each of the rectangular hazards having two spikes extending from a bottom portion thereof, the two spikes serving to embed the rectangular hazards into the yard;

a plurality of arched hazards, each of the arched hazards comprising a series of hollow arches in a common plane allowing for a golf ball's passage therethrough, each of the arched hazards having two spikes extending from a bottom portion thereof, the two spikes serving to embed the arched hazards into the yard;

a plurality of golf holes, each of the golf holes having a bottom portion and a cylindrical side wall extending perpendicularly upward therefrom, the cylindrical side wall terminating in an open upper periphery, the bottom portion having an aperture formed therethrough;

a plurality of lids, each of the lids having a flange extending downwardly therefrom inwardly of an outer periphery thereof, each of the lids adapted to be received within the open upper periphery of the plurality of golf holes, with the flange snapidly engaging the open upper periphery of the plurality of golf holes, each lid having an indented handle formed therein for the engagement and disengagement of the lids from the holes;

a plurality of flags, each of the flags having a first surface and a second surface, each of the flags having a shaft extending downwardly therefrom, each of the shafts having an end portion adapted to be received within the aperture formed through the plurality of golf holes;

a plurality of stick-on numbers, each of the stick-on numbers adapted to be coupled with the first surface and the second surface of the plurality of flags, the stick-on numbers serving to indicate a number of a golf hole;

a plurality of golf balls, each of the golf balls adapted to be received within the plurality of golf holes.

* * * * *